United States Patent [19]

Vann et al.

[11] Patent Number: 4,554,975

[45] Date of Patent: Nov. 26, 1985

[54] HOLD DOWN APPARATUS FOR WIRELINE OPERATED GUN

[75] Inventors: Roy R. Vann, Houston; Flint R. George, Katy, both of Tex.

[73] Assignee: GEO VANN, Inc., Houston, Tex.

[21] Appl. No.: 385,528

[22] Filed: Jun. 7, 1982

[51] Int. Cl.[4] ..... E21B 43/119

[52] U.S. Cl. ..... 166/297; 166/55.1; 175/4.52

[58] Field of Search ..... 166/55.1, 209, 210, 166/213, 216, 217, 240, 297, 382; 175/4.52, 322; 102/21.8

[56] References Cited

U.S. PATENT DOCUMENTS

| | | | |
|---|---|---|---|
| 1,608,167 | 11/1926 | Crowell et al. | 166/210 |
| 2,173,903 | 9/1939 | Halliburton | 166/217 |
| 3,054,454 | 9/1962 | Evans | 166/138 |
| 3,209,832 | 10/1965 | Tausch | 166/138 |
| 3,695,368 | 10/1972 | Lanmon, II | 175/4.52 |

*Primary Examiner*—Stephen J. Novosad
*Assistant Examiner*—William P. Neuder

[57] ABSTRACT

A hold down apparatus for a wireline operated perforating gun which prevents the gun from being thrust uphole when the gun is fired. The hold down apparatus enables the gun to be run downhole in a tubing or casing string, without the necessity of filling the pipe with liquid. The hold down apparatus includes a releasable anchor apparatus which is selectively set when the gun is manipulated vertically in a particular manner by the wireline. The gun is run downhole and positioned at the zone where the perforations are to be formed. The gun is lifted a finite distance, then lowered a finite distance, and then lifted again, thereby setting a pair of slips which are located in underlying relationship with respect to the gun. The gun remains anchored downhole so long as tension is maintained on the wireline. The gun is fired and subsequently released by lowering the gun a finite distance whereupon the anchoring device releases the slips from engagement with the piping. The gun can then be lifted uphole. Another zone can be perforated by again lowering the gun and then lifting the gun whereupon the anchor apparatus is again set. This manipulation of the gun with the wireline in order to release or set the anchor apparatus can be continued as many times as desired.

12 Claims, 7 Drawing Figures

360°

HOLD DOWN APPARATUS FOR WIRELINE OPERATED GUN

BACKGROUND OF THE INVENTION

After a borehole has been formed downhole into the earth and the casing cemented into place, the well must be completed by lowering a perforating gun downhole into a position adjacent to a hydrocarbon-containing formation. There may be several different elevations or pay zones to be perforated with the gun, and accordingly, it is often necessary to be able to relocate the gun several different times in order to perforate all of the hydrocarbon-containing formations.

In the past, it has been found to be difficult to detonate a large wireline operated casing type perforating gun in a dry hole because the tremendous energy released by the gun thrusts the gun uphole and entangles the gun with the wireline, thus necessitating a costly fishing job. For this reason, it is customary to fill the wellbore with a liquid, thereby dampening this upthrust action when the perforating gun is detonated. However, there are many instances where it is advantageous to perforate a dry hole as opposed to a wet hole. This is especially so where it is advantageous to develop a maximum pressure differential between the formation and the interior of the casing at the moment the casing is perforated. Such a situation is frequently encountered with respect to old wells that are no longer producing or have never produced, and are cased down to the pay zones but contain no tubing or other piping in the wellbore, for example. Since such wells may not be capable of production even after perforation of all the potential pay zones, the more costly and complicated techniques and apparatus employed with wet hole perforating practices are often not practical or justified. Perforation with a wireline operated casing type gun in these old, dry wells, on the other hand, is relatively efficient and economical, thereby avoiding one of the primary obstacles in the way of putting such wells in useful service.

Various devices and methods have been tried in the past to secure a wireline operated casing type perforating gun to the piping to prevent upthrust of the gun upon detonation, but these prior art approaches have been unsatisfactory because they do not enable the gun to be securely anchored prior to detonation, but instead are actuated by the detonation itself, when the gun is being thrust upwardly with great force. This upward thrust of the gun sometimes prevents the prior art anchoring devices from securely engaging the piping, thereby resulting in the gun being thrust uphole with the accompanying wireline entanglement problems and subsequently required fishing job referred to above.

Accordingly, it would be desirable to provide a wireline operated jet perforating gun with anchoring means by which the gun could be safely and releasably anchored downhole in a borehole prior to detonation of the gun in a manner to prevent upthrust of the gun when the gun is detonated. It would furthermore be desirable to be able to relocate a select fire perforating gun any number of times so as to achieve perforation of a plurality of different hydrocarbon-containing formations in a single trip into a dry wellbore.

Apparatus and method which attains the above desirable goals is the subject of the present invention.

SUMMARY OF THE INVENTION

A hold down apparatus is connected to a wireline actuated perforating gun which enables the gun to be run downhole, securely anchored to the piping prior to detonation of the gun, released after detonation and moved to a new location in the well and reanchored as many times as desired for subsequent detonations, thereby enabling perforating operations to be carried out at several different elevations downhole in the borehole. The hold down apparatus enables a large casing type gun to be detonated in a dry hole.

The preferred form of the hold down apparatus according to the present invention comprises a mandrel having one end attached to the gun and another end attached to a member which expands a set of slips against the casing wall. The slips are connected to a drag means and a J-slot is formed in the mandrel. The J-slot is of a configuration which enables the expanding apparatus to urge the slips against the wall and anchor the gun downhole when the gun is lifted in an upward direction by the wireline. Thereafter, the gun is lowered to release the slips. When the gun is again lifted, the slips are latched in the retracted position. The gun can again be lowered and again lifted whereupon the cooperative action between the drag means, slips, and J-slot again expands the slips into engagement with the casing wall, thereby again anchoring the gun downhole. Accordingly, the gun can be anchored downhole in a number of different locations by repeatedly lifting and lowering the gun in the above described manner.

In one specific embodiment of this invention, the mandrel is attached to the lower end of the gun and has a cone mounted at the lower end thereof, with the cone enlarging in a downhole direction. The cone bears against a plurality of slips. Spring bows attach the slips to a pin support member which is slidably received by the mandrel. The spring bows drag against the casing wall. When the gun is lifted uphole, the outer surface of the cone engages the inner slip surface, thereby expanding the slips into engagement with the casing wall. When the gun is lowered, the cone moves away from the slips, thereby enabling the slips to move radially inwardly away from the wall and release the gun.

A J-slot is formed circumferentially about the mandrel. A pin connected to the pin support member rides in the J-slot. The J-slot has a configuration which alternately expands and then releases the slips from engagement with the casing wall as the gun is manipulated by the wireline.

Accordingly, a primary object of the present invention is the provision of a hold down apparatus by which a jet perforating gun can be releasably anchored downhole in a borehole.

Another object of the invention is the provision of a hold down apparatus which enables a jet perforating gun to be anchored downhole in a borehole at several different elevations so that several different formations can be completed in a single trip into a borehole.

A further object of this invention is the provision of a hold down apparatus for a wireline actuated perforating gun which enables the gun to be anchored downhole at any elevation in the borehole by manipulating the gun vertically by the wireline.

A still further object of this invention is the provision of a wireline actuated perforating gun which can perforate several different zones in a dry borehole by anchoring the gun in a releasable manner at any number of desired elevations, wherein the gun is anchored and subsequently released by picking up and lowering the gun with the wireline.

An additional object of this invention is the provision of a method of releasably anchoring a jet perforating gun downhole in a borehole by manipulating the gun with a wireline.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figures 1, 2, 3, 4, 5, 6, 7:
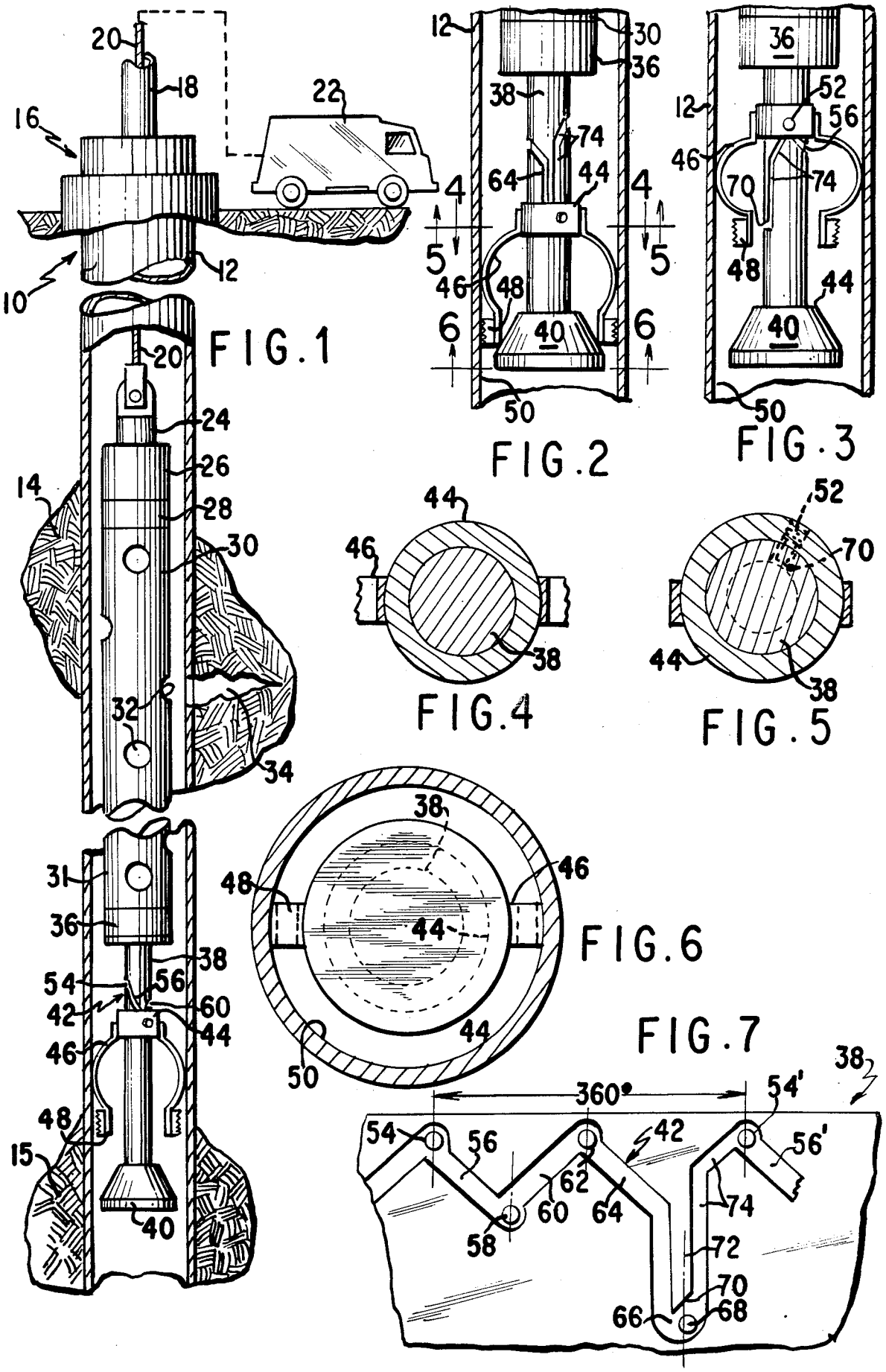
FIG. 1 sets forth a partly diagrammatic, partly schematic, partly cross-sectional view of a borehole having apparatus made in accordance with the present invention associated therewith.
FIG. 2 is a fragmented, partly longitudinal cross-sectional view of part of the apparatus disclosed in FIG. 1.
FIG. 3 is similar to FIG. 2 and illustrates the apparatus of the present invention in a different configuration.
FIGS. 4, 5, and 6, respectively, are cross-sectional views taken along lines 4—4, 5—5, and 6—6, respectively, of FIG. 2; and, FIG. 7 is a hypothetical, diagrammatic representation of part of the apparatus disclosed in the foregoing figures for purposes of illustrating the operation thereof.

FIG. 1 of the drawings discloses a borehole 10 which extends downhole from the surface of the earth. The borehole is cased as indicated by numeral 12. The casing extends down through a hydrocarbon-containing formation 14, and there may be other hydrocarbon-containing formations located further downhole as indicated by the numeral 15.

A wellhead 16 of conventional design has a lubricator 18 connected thereto, the details of which are known to those skilled in the art. A wireline 20 is connected to appropriate prior art apparatus contained within a logging truck 22 and extends through a lubricator and downhole to a rope socket 24. The rope socket is connected to a sub 26, which in turn is connected to a gun firing head 28. The gun firing head can take on several different forms, and may be a select fire device which sequentially and selectively fires a number of different series connected perforating guns, one of which is seen indicated by numeral 30, and another indicated by numeral 31. The perforating gun includes a plurality of shaped charges 32, which may be arranged in any desired pattern, so that when the shaped charges are detonated, a passageway or tunnel 34 is formed which extends from the gun, through the wall of the casing, and into the hydrocarbon-containing formation.

The lower end of the lowermost gun 31 terminates in a sub 36 to which one end of a mandrel 38 is affixed. The other end of the mandrel terminates in a cone apparatus 40. The cone enlarges downwardly and outwardly. The mandrel has a J-slot 42 formed about the circumference or outer peripheral surface of a medial portion thereof. A pin support member 44, preferably in the form of a hollow cylinder, is reciprocatingly received by a medial longitudinal extending part of the mandrel. Drag devices 46, which may be in the form of a metal spring bow, have one end attached to the pin support member and the other end affixed to a slip 48, with there being a plurality of bows and slips radially spaced from one another. The drag devices always drag against the casing wall with sufficient frictional force against the casing wall to hold the pin support member in place while the gun is being manipulated up and down by the wireline.

The slips normally are biased so as to be retracted away from the interior wall 50 of the casing, as illustrated in FIG. 3, and can be urged radially outwardly by the cone into securely anchored frictional engagement with the casing wall as illustrated in FIG. 2.

The configuration of the J-slot 42 is more particularly illustrated in FIG. 7. It will be appreciated by reference to FIG. 7 that a pin in position 54 will be moved down angled leg 56 into position 58 whenever the gun is picked up. The pin moves along leg 60 into position 62 when the gun is set down a first time. The pin moves along leg 64 into the long J-slot leg at 66 and into latched or anchored position 68 when the gun is picked up a second time. The gun is anchored downhole in the borehole by the slips when the pin 52 is in the position 68 of the long slot.

Angle wall 70 overhangs position 68 as noted by the dot-dash line identified by numeral 72, and accordingly, when the gun is set down a third time, the pin rides along leg 74 into position 54', thereby completing 360° of radial travel. That is, position 54' is identical to the first mentioned position 54 and leg 56' is identical to leg 56. Accordingly, the gun is manipulated vertically by the wireline in order to effect relative movement between the J-slot 42 and pin 52 so that the gun can be run into the hole with the pin being in position 54, until the gun arrives at the first zone to be completed. The gun is next picked up, thereby moving the pin into position 58 so that the gun can be retrieved from the borehole without detonation if desired. The gun thereafter can again be set down, thereby moving the pin into position 62. The next pick up of the gun moves the pin along the leg 64 of the slot and along the long leg 66 of the J-slot into position 68, thereby anchoring the gun downhole in the casing. When the gun is set down again, the pin moves into position 54'. The gun can be alternately picked up and set down, thereby alternately anchoring and releasing the gun from the interior wall of the casing. Accordingly, the gun can be anchored adjacent to a plurality of different formations 14, 15, by making a single trip into the borehole. The employment of a select fire jet perforating gun enables any number of different formations to be completed in a single trip into the well. It is preferred to begin the perforating operations at the lowermost zone to be completed and work upwardly toward the surface, in order to avoid debris, caused by the previous detonations of other guns, from accumulating above the guns. It will be understood, of course, that in the event a perforated formation begins to produce in sufficient or desired quantities, the guns may be released from the casing wall and retrieved to the surface without further detonations during that particular trip into the wellbore.

In the claims herein, the term "cone" is intended to mean a conical device such as illustrated by numeral 40, including the specifically illustrated frustum of a cone. Those skilled in the art, however, will realize that the cone 40 could have an outer surface of a different shape, for example curved, rather than conical. Moreover, the cone 40 need not be continuous as illustrated but instead could be a wedge-shaped apparatus having a wedge surface of sufficient width to engage each of the slips 48.

The pin support member 44 is illustrated as being cylindrical; the pin support member could, however, have another shape, such as hexagonal, octagonal, or the like, and still function as described above.

It should be understood that the guns 30 and 31 usually comprise a number of guns connected together in series so as to provide an optimum number of shaped charges which are arranged to penetrate the formation along a predetermined length of the borehole. Sometime a single firing of the gun can achieve the desired perforating pattern, and at other times, it may be desirable to use a select fire gun so that only one shaped charge is fired at a time. At other times, clusters of shaped charges are selectively fired so that a plurality of perforations are achieved at one elevation and thereafter, a plurality of perforations are achieved at another elevation. In any event, the apparatus of the present invention enables the jet gun to be located at any number of different elevations in a single trip into the borehole.

In the claims, the term "piping" is intended to mean casing or tubing. The present invention could therefore be advantageously employed in conjunction with a through tubing perforating gun, as well as the illustrated casing gun.

Other modifications in and to the apparatus disclosed herein may be made by those skilled in the art without departing from the spirit of the present invention. For example, other types of drag devices can be used, so long as they provide the requisite frictional engagement with the piping wall to allow vertical manipulation of the guns by the wireline and indexing of the pin in the J-slot, and other types of slips can be used, so long as they grip the piping wall with sufficient force to securely anchor the guns prior to and during detonation. Also, the axial length of the J-slot can be shortened from that illustrated herein so as to obtain the minimum or optimum amount of vertical travel required in order to index the pin properly in the J-slot to actuate and release the slips. Also, jarring devices could be included in order to joltingly engage the slips to release them from the piping wall in case they become stuck.

I claim:

1. In a perforating gun adapted to be lowered downhole on a wireline through the substantially dry flowbore of a string of piping and positioned adjacent to a zone to be perforated, the combination with said gun of a gun hole down apparatus;

said hold down apparatus including a mandrel having one end affixed to the gun and a slip actuating device affixed to the other end of the mandrel, there being a medial length of the mandrel located between said slip actuating device and said gun;

a slip support member slidably received about said medial mandrel length, a 360° slot being formed in one of said medial mandrel length and said slip support member and including a pin having one end disposed in the other of said medial mandrel length and said slip support member, the other end of said pin being received in said 360° slot;

drag means connected to said slip support member for frictionally engaging the wall of such piping string;

slip means connected to said drag means for releasably securely engaging such wall of such piping string against an upward force on such perforating gun;

means by which said slip actuating device engages said slip means and forces said slip means outward into engagement with the inside surface of such piping wall when said slip actuating device moves upwardly relative to said slip support member;

said 360° slot including a plurality of legs connected together and circumferentially arranged about said mandrel such that when the gun is lifted one time, said pin bottoms in a portion of said 360° slot which prevents said slip means from being actuated, and when the gun is lifted a second time, said pin bottoms in another portion of said 360° slot which permits said slip actuating device to engage and actuate said slip means against such piping wall whereby upon the detonation of the gun, the upthrust on the gun is negated by the slip actuating device forcing the slip means outwardly into engagement with the piping wall to secure the gun downhole.

2. The combination of claim 1 wherein said 360° slot is formed about a medial length of the mandrel, and said pin is affixed to said slip support member.

3. The combination of claim 2 wherein said drag means is a resilient bow which extends in a biased manner radially outward against the piping wall.

4. The combination of claim 3 wherein said slip actuating means is a cone member which enlarges downwardly, and said slip support member moves along said mandrel and towards said cone member, said cone member being received within said slip means and urging said slip means against the wall of the piping.

5. The combination of claim 4 wherein said 360° extends 360° about the mandrel and includes a running in position and an anchored position.

6. The combination of claim 1 wherein said drag means is a resilient bow which extends in a biased manner radially outward against the piping wall;

said slip actuating means is a cone member which enlarges downwardly, and said slip support member moves along said mandrel and toward said cone member, said cone member is received within said slip means and urges said slip means against the wall of the piping.

7. The combination of claim 1 wherein said slip actuating means is a cone member which enlarges downwardly, and said slip support member moves along said mandrel and toward said cone member, said cone member is received within said slip means and urges said slip means against the wall of the piping.

8. Method of completing a cased and substantially dry borehole with a perforating gun suspended by a wireline comprising the steps of:

(1) running a perforating gun on the wireline downhole into the substantially dry borehole and positioning the gun adjacent to a payzone to be completed;

(2) engaging the well casing wall with a drag spring, and supporting a set of slips on the end of the drag spring, and biasing the slips inwardly of the casing wall with the drag spring;

(3) supporting a slip setting device on the end of a mandrel extending from the lower end of the gun;

(4) slidably connecting the drag spring to the mandrel on the lower end of the gun;

(5) providing a 360° slot on the mandrel and a pin on the drag spring;

(6) actuating the slips by vertical reciprocal movement of the gun and to latch the slips in a non-engaging position when the gun is reciprocated by the wireline a first time and to latch the slips into the engaging position when the gun is reciprocated by the wireline a second time; and (7) preventing the gun from moving uphole upon detonation of the gun by the slips engaging the casing wall.

9. The method of claim 8 wherein said slip setting device is a conical member which moves towards the slips when the gun is set down.

10. The method of claim 8 wherein said slip setting device is a conical member which moves towards the slips when the gun is set down.

11. Device for anchoring a wireline actuated gun lowered down a pipe string to the wall of such pipe string, comprising:

a mandrel depending from said gun;

a slip support member slidably disposed about said mandrel;

a 360° slot circumferentially disposed around one of the outer surface of the mandrel and the inner surface of the slip support member, and a pin attached to the other of such surfaces and riding in said 360° slot;

drag means disposed on said slip support member for dragging against such wall of such pipe string;

slip means supported by said drag means for alternating engaging with and disengaging from such wall of such pipe string;

slip actuation means disposed on said mandrel for engagement with said slip means for actuating said slip means into engagement with such wall of such pipe string when said support member slides a sufficient distance along said mandrel toward said slip actuation means;

said 360° slot having configurated means responsive to successive vertical displacements of said gun after said gun is lowered into such pipe string for regulating the longitudinal axial travel of said pin relative to said mandrel for preventing said slip support member from sliding such a sufficient distance and engaging such wall when the gun is lifted a first time, and for allowing said slip support member to slide such a sufficient distance to engage such wall when the gun is lifted a second time whereby upon the detonation of the gun, the upthrust on the gun is prevented from blowing the gun uphole by the slip actuation means forcing the slip means into engagement with such wall to secure the gun downhole.

12. Apparatus for releasably anchoring a wireline operated perforating gun within a cased and substantially dry borehole, comprising:

an elongate member depending from said gun;

a support member reciprocably disposed on said elongate member;

a plurality of drag springs having one end affixed to said support member;

slip means affixed to the other end of said drag springs movable from a first position where said slip means anchors against the cased borehole to a second position where said slip means does not engage the cased borehole;

cooperable reciprocable means disposed on said support member and said member for reciprocating said slip means between said first and second positions;

cooperable means disposed on said elongate member for actuating said reciprocable means; and a conical member disposed on said elongate member for moving said means into engagement with the cased borehole.

* * * * *

UNITED STATES PATENT AND TRADEMARK OFFICE

CERTIFICATE OF CORRECTION

PATENT NO. : 4,554,975

DATED : November 26, 1985

INVENTOR(S) : Vann et al.

It is certified that error appears in the above-identified patent and that said Letters Patent is hereby corrected as shown below:

In column 4, line 4, following the word "slip" delete the numeral [48].
In column 5, line 53, delete the word [hole] and insert therefor --hold--.
In column 7, line 28, delete the word [alternating] and insert therefor --alternately--,
In column 7, line 34, following the word "said" insert the word --slip--.

Signed and Sealed this

*Sixteenth* Day of *September 1986*

[SEAL]

*Attest:*

DONALD J. QUIGG

*Attesting Officer*

*Commissioner of Patents and Trademarks*